US011497967B2

(12) United States Patent
Hernandez

(10) Patent No.: US 11,497,967 B2
(45) Date of Patent: Nov. 15, 2022

(54) TWIRL TRAINING DEVICE

(71) Applicant: Miguel Vicente Hernandez, Miami, FL (US)

(72) Inventor: Miguel Vicente Hernandez, Miami, FL (US)

( * ) Notice: Subject to any disclaimer, the term of this patent is extended or adjusted under 35 U.S.C. 154(b) by 142 days.

(21) Appl. No.: 17/136,626

(22) Filed: Dec. 29, 2020

(65) Prior Publication Data

US 2022/0203172 A1 Jun. 30, 2022

(51) Int. Cl.
*A63B 26/00* (2006.01)

(52) U.S. Cl.
CPC .... *A63B 26/003* (2013.01); *A63B 2208/0209* (2013.01); *A63B 2244/22* (2013.01)

(58) Field of Classification Search
CPC ..... A63B 26/003; A63B 2208/0209; A63B 2244/22; A63B 24/0087; A63B 2225/62; A63B 2220/56; A63B 2220/18; A63B 21/4033; A63B 5/16; A63B 21/00047; A63B 23/0458; A63B 71/0054; A63B 2225/76; A63B 2071/0063; A63B 2071/0633; A63B 2225/093; A63B 71/0036; A63B 2209/00; A63B 2071/0694; A63B 2209/10; A63B 2210/50
See application file for complete search history.

(56) References Cited

U.S. PATENT DOCUMENTS 3,399,407 A * 9/1968 Thomas ..... A63B 6/02 182/139
4,126,326 A * 11/1978 Phillips ..... A63B 26/003 280/220
4,787,630 A * 11/1988 Watson ..... A63B 22/14 482/146
5,269,735 A * 12/1993 Pfitzenmeier ..... A63B 23/0458 472/108
7,563,216 B1 * 7/2009 Kest ..... A63B 23/03533 482/141
7,730,634 B2 * 6/2010 LaDuca ..... A43B 23/047 36/108
10,265,582 B2 * 4/2019 Price ..... A63B 23/025
10,772,377 B2 * 9/2020 Bray, Jr. ..... A43B 1/14
11,071,347 B2 * 7/2021 Kendall ..... A43B 13/141
2004/0087421 A1 * 5/2004 Lin ..... A63B 26/003 482/148
2006/0174512 A1 * 8/2006 LaDuca ..... A43B 3/08 36/8.3
2012/0096654 A1 * 4/2012 Huebner ..... A43D 3/1408 12/115.4

(Continued)

*Primary Examiner* — Garrett K Atkinson
(74) *Attorney, Agent, or Firm* — Ruben Alcoba, Esq.

(57) ABSTRACT

A twirl training device that is a mold that has a top and a bottom side. The top side receives the foot of a user. A front part of the top side of the mold receive the ball of the foot of the user. A middle part of the top side of the mold defines an instep that rises at an angle from about thirty degree to about 45 degree from the front part of the top side of the mold. The rear part of the top side is a heel portion. The bottom side of the mold has a front portion, a middle portion and a rear portion, the front and middle portion of the bottom side slope upward from the rear portion of the bottom side. The heel portion of the top side and the rear portion of the bottom side are parallel. The twirl training device has a width that is at least two and half inches.

4 Claims, 5 Drawing Sheets

(56) References Cited

U.S. PATENT DOCUMENTS

| | | | | |
|---|---|---|---|---|
| 2014/0274606 | A1* | 9/2014 | Piskin | A63B 21/16<br>482/129 |
| 2017/0136372 | A1* | 5/2017 | Koide | A63G 31/007 |
| 2018/0085623 | A1* | 3/2018 | Flook | A63B 21/0557 |
| 2018/0125156 | A1* | 5/2018 | Bray, Jr. | A43B 1/14 |
| 2018/0271735 | A1* | 9/2018 | Drucker | A63B 21/4037 |
| 2019/0269199 | A1* | 9/2019 | Freed | A43B 5/12 |
| 2019/0365032 | A1* | 12/2019 | Kendall | A43B 13/18 |
| 2020/0253323 | A1* | 8/2020 | Fox | A43B 3/0036 |

* cited by examiner

TWIRL TRAINING DEVICE

BACKGROUND

The present invention is directed to a training device that can be used by dancers and gymnast to improve their balance when twirling.

The inventor of the present invention was a gymnast that eventually became a physical trainer of dancers.

During his training of dancers he realized that most dancers lost their vertical alignment when twirling.

He researched devices in the market that helped dancers with their alignment, yet he found none that prevented dancers from cheating when twirling. Dancers tended to allow their buttocks to rest downward, sitting, when twirling, thereby causing the alignment of the dancer to be distorted.

The present device ensures that dancers remain aligned by raising the instep portion of the device and thereby raising buttocks of the dancer when twirling.

The device of the present invention addresses the need of having a twirling device that allows a user of the device to remain vertically aligned with his or her raised buttocks.

SUMMARY

The present invention is a twirl training device that allows dancers or gymnasts to correct their alignment when twirling.

The twirl training device is a mold that has a top and a bottom side. The top side receives the foot of a user. A front part of the top side of the mold receive the ball of the foot of the user. A middle part of the top side of the mold defines an instep that rises at an angle from about thirty degree to about 45 degree from the front part of the top side of the mold. The rear part of the top side is a heal portion. The bottom side of the mold has a front portion, a middle portion and a rear portion, the front and middle portion of the bottom side slope upward from the rear portion of the bottom side. The heal portion of the top side and the rear portion of the bottom side are parallel. The twirl training device has a width that is at least two and half inches.

The purpose of the twirl training device of the present invention is to improve the muscle tone of all of the muscles used when twirling, while preventing injuries that may occur when the proper alignment is not attained when twirling.

An object of the present invention is to provide a device that will help an athlete optimize vertical alignment when twirling.

Another object of the present invention is to provide a device that will help an athlete increase the muscle tone of muscles used when twirling. Muscles used when twirling are the Gastrocnemius, the soleus, the fibularis longus and the tibialis anterior.

Yet another object of the present invention is to provide a device that will ensure that athletes keep their buttocks at an upward position when twirling.

DRAWINGS

These and other features, aspects, and advantages of the present invention will become better understood with regards to the following description, appended claims, and drawings where:

DESCRIPTION

Figure 1:
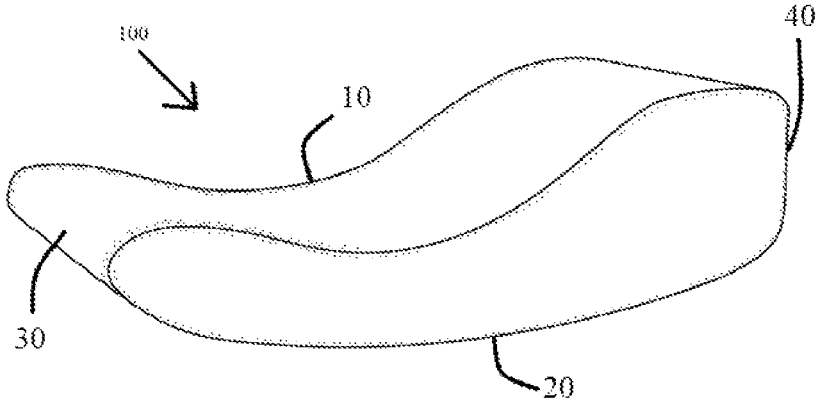
FIG. 1 is a left perspective view of the present application.
Figure 2:
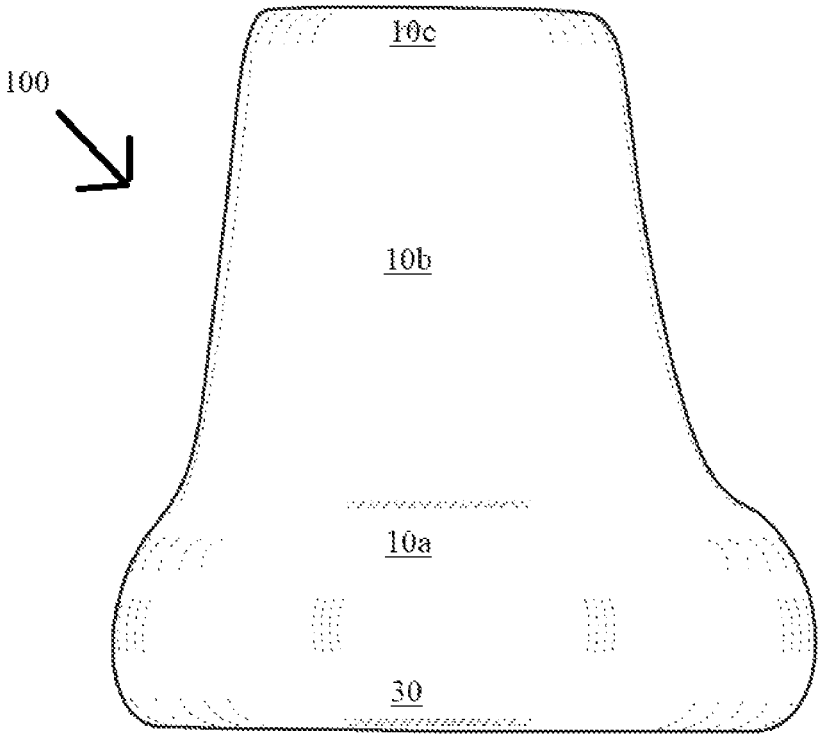
FIG. 2 is a front view of the present application.
Figure 3:
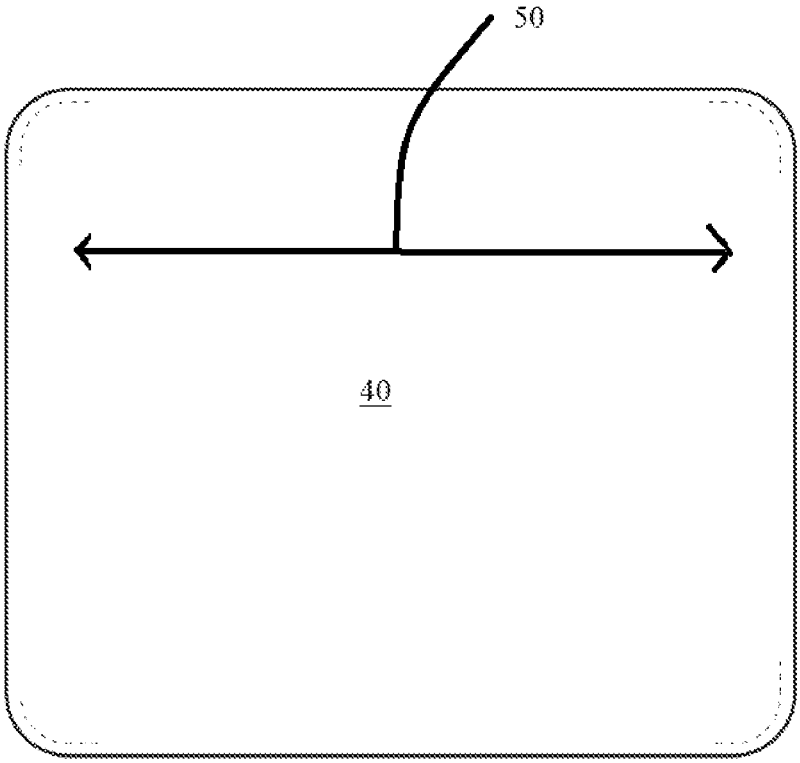
FIG. 3 is a rear view of the present application.
Figure 4:
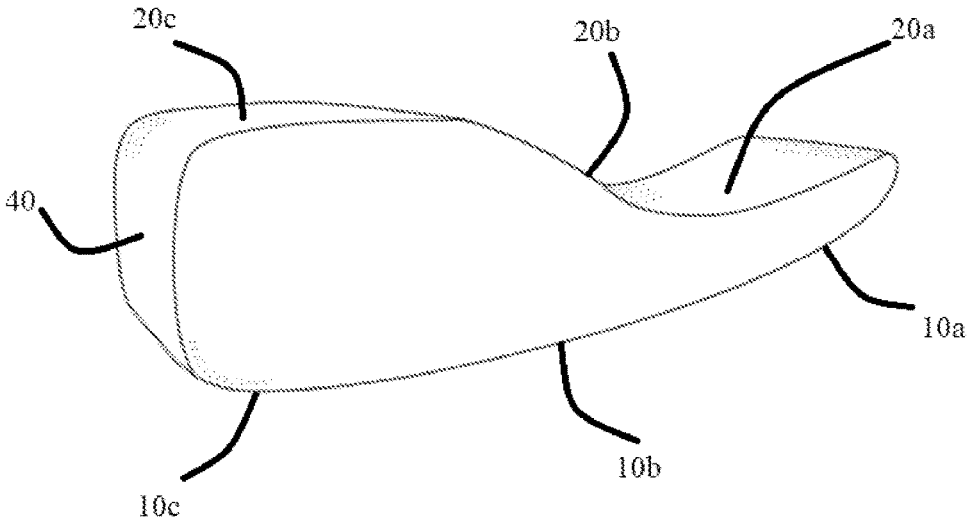
FIG. 4 is a right perspective view of the present application.
Figure 5:
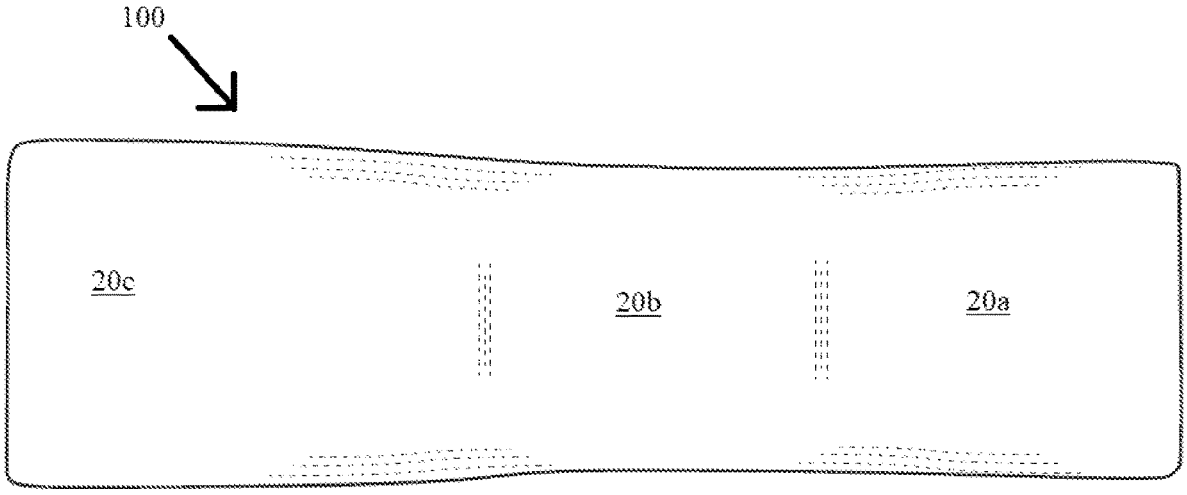
FIG. 5 is top plan view of the present application.
Figure 6:
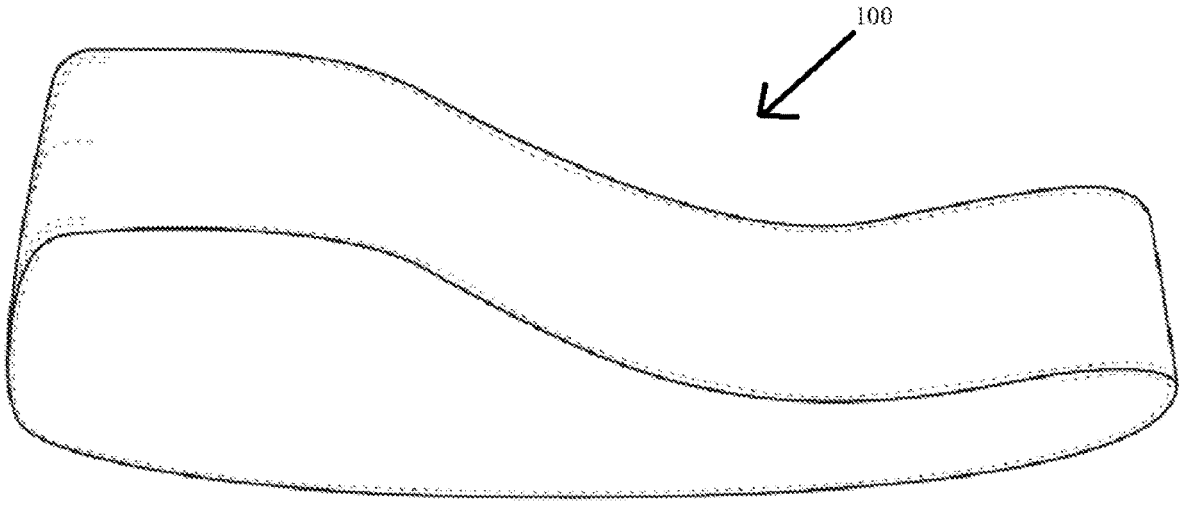
FIG. 6 is a top right side view of the present application.
Figure 7:
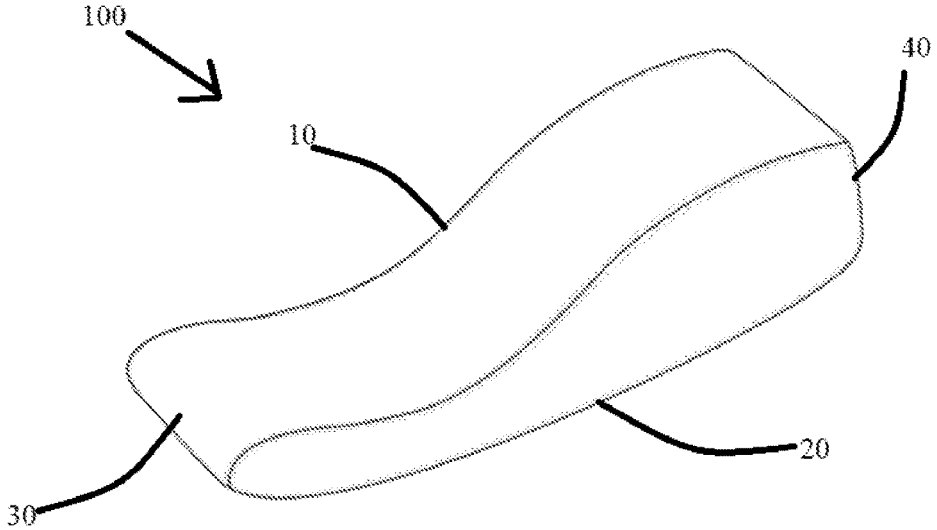
FIG. 7 is another left perspective view of the present application.

As shown in FIGS. 1-8, the present invention is a twirl training device. The twirl training device 100 comprises a mold 100 that has a top side 10, a bottom side 20, a front side 30 and a rear side 40, the mold 100 has a width 50 of at least two and a half inches; wherein the top side 10 of the mold 100 defines a ball portion 10*a*, an instep portion 10*b* that rises upward at least two and a half inches, at angle that is from about thirty to about forty five degrees, from the ball portion 10*a*, and a heel portion 10*c*, and wherein the bottom side 20 of the mold 100 defines a front portion 20*a*, middle portion 20*b* and rear portion 20*c*, the front 20*a* and middle portion 20*b* slope upward from the rear portion 20*c*, and wherein the heel portion 10*c* of the top side 10 of the mold 100 and the rear portion 20*c* of the bottom side 20 of the mold 100 are parallel.

In preferred embodiments of the present invention, the top side of the twirl training device measures a length of at least seven inches and the bottom side measures a length of at least seven inches.

In embodiments of the present invention, the twirl training device is made of wood.

In further embodiments of the present invention, the twirl training device is made of a polymer.

Figure 8:
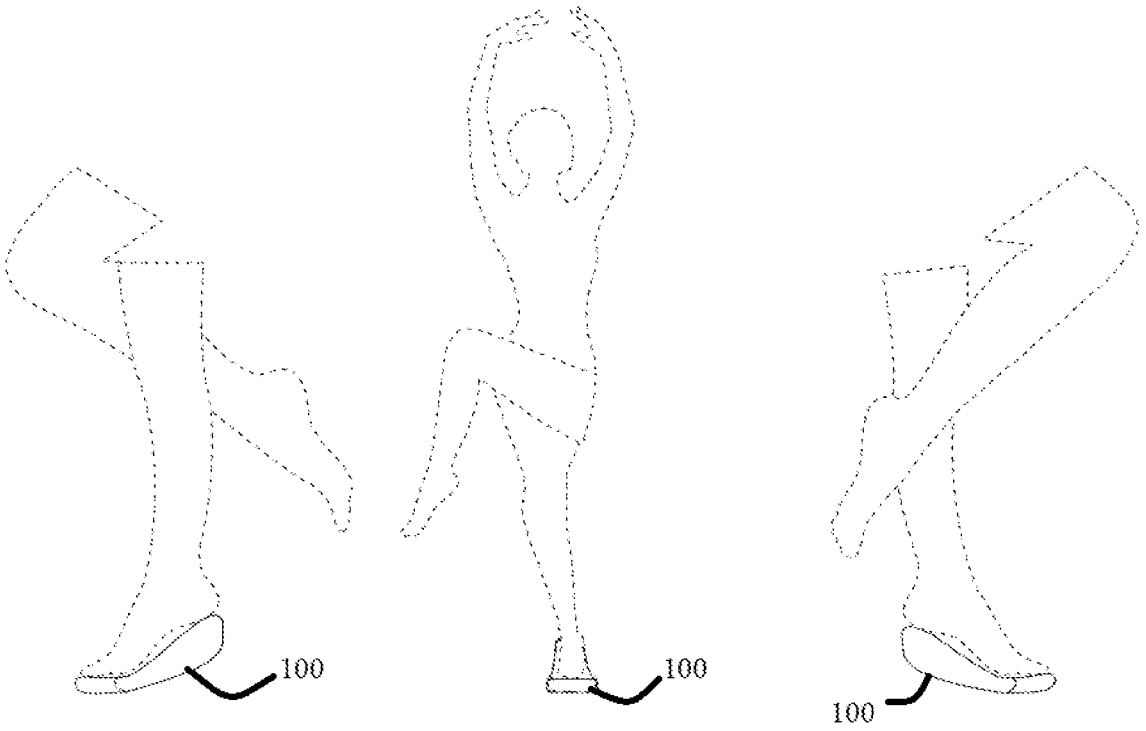
FIG. 8 is a representation of three figures that show how the present application is used.

As seen in FIG. 8, the present invention is used by having a user place the ball of one of the user's feet on the ball portion of the device and then performing a normal twirling motion. When the user rests on the device, the user can either rest by placing the user's weight on the ball portion of the device or on the heel portion of the device.

An object of the present invention is to provide a device that will help an athlete optimize vertical alignment when twirling.

Another object of the present invention is to provide a device that will help an athlete increase the muscle tone of muscles used when twirling. Muscles used when twirling are the Gastrocnemius, the soleus, the fibularis longus and the tibialis anterior.

Yet another object of the present invention is to provide a device that will ensure that athletes keep their buttocks at an upward position when twirling.

The embodiments of the twirl training device described herein are exemplary and numerous modifications, combinations, variations, and rearrangements can be readily envisioned to achieve an equivalent result, all of which are intended to be embraced within the scope of the appended claims. Further, nothing in the above-provided discussions of the twirl training device should be construed as limiting the invention to an embodiment or a combination of embodiments. The scope of the invention is defined by the description, the drawings and the appended claims.

What is claimed is:

1. A twirl training device, the twirl training device comprising:

a mold that has a top side, a bottom side, a front side, and a rear side, the mold has a width of at least two and a half inches;

wherein the top side of the mold defines a ball portion, an instep portion that rises upward at least two and a half inches, at an angle that is from about thirty to about forty five degrees, from the ball portion, and a heel portion, the ball portion is configured to receive the ball portion of a foot of a user and the instep portion is configured to ensure that the user displaces his weight on the ball portion when twirling, the displacement of the weight on the ball portion ensures that the buttocks of the user is raised when spinning and that the user is vertically aligned when twirling; and wherein the bottom side of the mold defines a front portion, middle portion and rear portion, the front and middle portion slope upward from the rear portion, and wherein the heel portion of the top side of the mold and the rear portion of the bottom of the mold are parallel.

2. The twirl training device of claim 1, wherein the top side measures a length of at least seven inches and the bottom side measures a length of at least seven inches.

3. The twirl training device of claim 1, wherein the twirl training device is made of wood.

4. The twirl training device of claim 1, wherein the twirl training device is made of a polymer.

* * * * *